United States Patent [19]

Tazawa

[11] Patent Number: 4,643,388

[45] Date of Patent: Feb. 17, 1987

[54] DEVICE FOR HOLDING REINFORCING MATERIALS ON CONCRETE-APPLYING FRAMES

[75] Inventor: Yoshio Tazawa, Iiyama, Japan

[73] Assignee: Tazawa Koomuten Co., Ltd., Iiyamashi, Japan

[21] Appl. No.: 354,123

[22] Filed: Mar. 2, 1982

[30] Foreign Application Priority Data

| | | | |
|---|---|---|---|
| Mar. 9, 1981 | [JP] | Japan | 56-32403[U] |
| Apr. 11, 1981 | [JP] | Japan | 56-54841 |
| Jun. 18, 1981 | [JP] | Japan | 56-94169 |
| Oct. 14, 1981 | [JP] | Japan | 56-163845 |
| Nov. 11, 1981 | [JP] | Japan | 56-180782 |
| Nov. 11, 1981 | [JP] | Japan | 56-180783 |

[51] Int. Cl.[4] ..... E04G 17/04; E04G 17/14

[52] U.S. Cl. ..... 249/219 W; 248/205.1; 249/40; 249/190; 249/216; 403/49; 403/386; 403/400

[58] Field of Search ..... 249/219 R, 216, 219 W, 249/167, 190, 40; 256/68, 69, 70; 248/205.1, 316.2, 316.5; 403/49, 386, 400

[56] References Cited

U.S. PATENT DOCUMENTS

| | | | |
|---|---|---|---|
| 648,219 | 4/1900 | Rupp | 403/400 |
| 2,819,861 | 1/1958 | Vines | 249/219 W |
| 2,977,659 | 4/1961 | Buxton | 249/219 W |
| 3,343,771 | 9/1967 | Gates | 249/219 W |
| 4,003,546 | 1/1977 | Johnson | 249/219 W |
| 4,185,804 | 1/1980 | Baculo | 249/219 W |
| 4,193,708 | 3/1980 | Kitchen et al. | 403/386 |

FOREIGN PATENT DOCUMENTS

| | | | |
|---|---|---|---|
| 411403 | 6/1934 | United Kingdom | 403/386 |
| 1537229 | 12/1978 | United Kingdom | 403/386 |

*Primary Examiner*—Jay H. Woo
*Assistant Examiner*—James C. Housel
*Attorney, Agent, or Firm*—Jordan and Hamburg

[57] ABSTRACT

An arm piece is put on the tip of a spacer projecting out through an outer wall of a frame board in such a way that the arm piece is fixed perpendicularly to the frame board positioned between the spacer flange and the arm piece. The arm piece, at its back end, is provided with a bearing section projecting upward. The bearing section is provided with a support piece capable of rotating toward and away from the frame board. The support piece is provided with a supporting section to catch a long reinforcing material for the frame board. The long reinforcing material is put into the supporting section and then the support piece is rotated toward the frame board. Thus, the long reinforcing material gets held between the supporting section and the outer wall of the frame board and the load exerted in the direction from the frame board is supported by the bearing section via the support piece.

6 Claims, 22 Drawing Figures

DEVICE FOR HOLDING REINFORCING MATERIALS ON CONCRETE-APPLYING FRAMES

DESCRIPTION OF THE PRIOR ART

In conventional frames for holding concrete in concrete-applying work, for example as shown in FIG. 1, reinforcing pipes 16 and 18, which are long reinforcing materials, are attached on a frame board 2.

In this system, a spacer 4 is provided so as to penetrate the frame board 2 from the inside to outside of a concrete cavity, a bolt 10 with a female screw 8 at its tip is screwed on a male screw 6 provided at the end of the spacer, thus allowing the frame board 2 to be held between the flange section 12 of the spacer 4 and a flange section 14 of the bolt 10 with the bolt 10 being fixed perpendicularly to the frame board 2. The reinforcing pipes 16 and 18 are situated aside the frame board 2 in a well crib, and a holding washer 20 is put on the bolt 10 extending outwardly between the two reinforcing pipes 18. A nut 24 is applied from behind the holding washer 20 onto a screw section 22 provided on the rear end of the bolt 10 to bring the holding washer 20 into tight contact with the reinforcing pipe 18.

The conventional system requires the holding washer 20 to be moved forward or backward more than 2 cm along the bolt 10 at each application or detachment of the reinforcing pipes 16 and 18. This movement of the holding washer 20, requiring the nut 24 to be turned more than 10 times, is so tedious and time-consuming. It is true that the longer the pitch of the nut 24 on the screw section 22, the less number of rotations the nut 24 requires, but, with longer pitches, the nut 24 would be apt to get loosened at the time of concrete application due to vibration caused by pump, vibrator, wooden hammer, etc., especially the nut 24 gets more easily loosened before the concrete being applied comes up to the level of the nut 24.

Moreover, since manual operation is used for the application of the nut 24 onto each bolt 10, there will be an uneven degree of tightness with the nut 24 and too much application of the nut 24 in fear of its loosening will often result in rupture of the spacer hole on the frame board 2, and thus the frame board 2 will get distorted so that the surface of the concrete will become so uneven as to require a considerable amount of mending work, with a great influence on the entire construction cost.

SUMMARY OF THE INVENTION

The main purpose of the present invention is to offer novel methods for holding reinforcing materials for concrete-applying frames which require only slight force of rotation of long reinforcing materials to apply the long reinforcing materials onto and detach them from the frame board with high rapidity, simplicity, and precision.

Another important purpose of the present invention is to offer novel tools for holding reinforcing materials for concrete-applying frames, which contain rotary support pieces to catch the long reinforcing material.

Another purpose of the present invention is to offer tools for holding reinforcing materials for concrete-applying frames which, for ensuring to hold the long reinforcing material at a more exactly defined position, contain a stopper piece at a prescribed position serving to prevent the support piece from rotating away from or toward the frame board.

Another purpose of the present invention is to offer novel tools for holding concrete-applying frames which enable a long reinforcing material as a whole to be rotated for application even when attaching positions of the arm pieces varies onto the frame board and which contain the support section on the support piece in such a form that the long reinforcing materials are to be supported in vertically allowable positions.

The other purpose of the present invention is to offer novel tools for holding concrete-applying frames which enable a long reinforcing material as a whole to be rotated for application even when in attaching positions of the arm pieces varies onto the frame board and which contain the support piece designed to be vertically movable with respect to the bearing section.

BRIEF DESCRIPTION OF THE DRAWINGS

FIG. 8(*b*) is a side view of the stopper piece.

FIG. 9 is a front view for another application example, in which

FIG. 15 is a front view of a spacer-catching section in the arm piece, in which

SPECIFICATION OF THE INVENTION

Several application examples of the present invention will be described in detail by use of the appended drawings.

Figure 1:
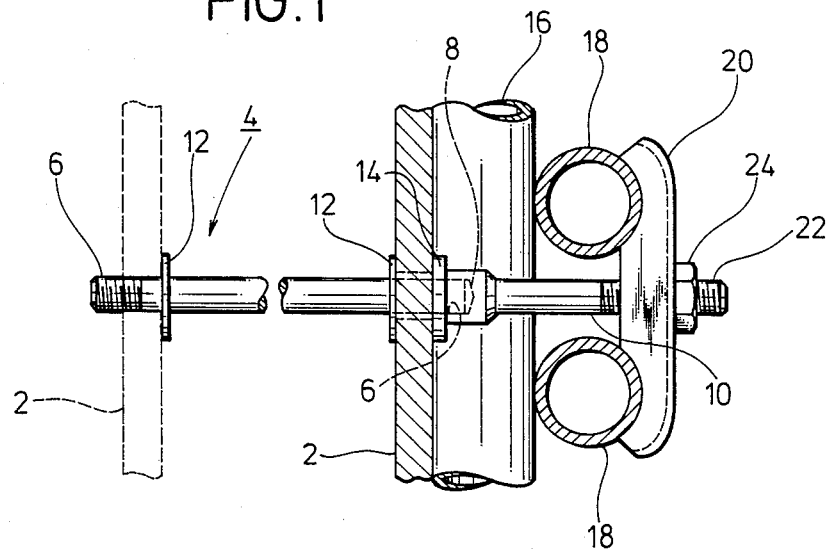
FIG. 1 is a front view in which a conventional tool for holding a concrete-applying frame is used to attach a long reinforcing material to a frame board.
Figure 2:
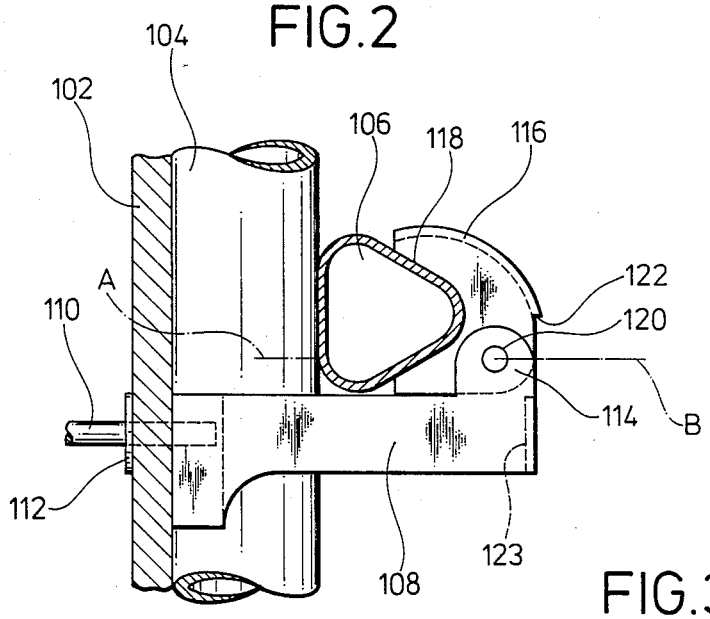
FIG. 2 is a front view of a tool for holding the concrete-applying frame of the present invention.
Figure 3:
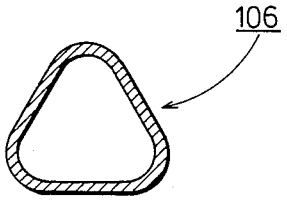
FIG. 3 is a cross-sectional view of an example of long reinforcing material.

In FIG. 2, 102 is a frame board, 104 is a fixed backup pipe (to be called as a fixed pipe hereinafter) made of long reinforced material, 106 is a movable backup pipe (to be called as a movable pipe hereinafter) made of long reinforcing material. Sets of fixed and movable pipes make a we11 crib. The movable pipe has a cross section of a form of triangle with corners rounded.

108 is an arm piece. Its front end is screwed on an end of a spacer 110 penetrating the frame board 102 and is in cooperation with a flange 112 on the spacer 110 to hold the frame board 102, thus fixing the arm piece 108 perpendicularly to the frame board 102.

114 is a bearing, which projects upward from both sides at the back end of the arm piece 108.

116 is a support piece, which possesses a supporting section 118 in an approximate V-form corresponding to the rounded-corner section of the triangular cross-section of the movable pipe 106 and which is capable of rotating about a rotary shaft 120 provided on the bearing 114 in the 90° range from the lateral to vertical direction, which rotation is controlled by a stopper 122 and a receiving section 123.

The rotary shaft 120 is on the level B which is flush with the lower contactend position A of the movable pipe 106 when this pipe has been brought into contact with the outer surface of the fixed pipe 104.

Figure 4:
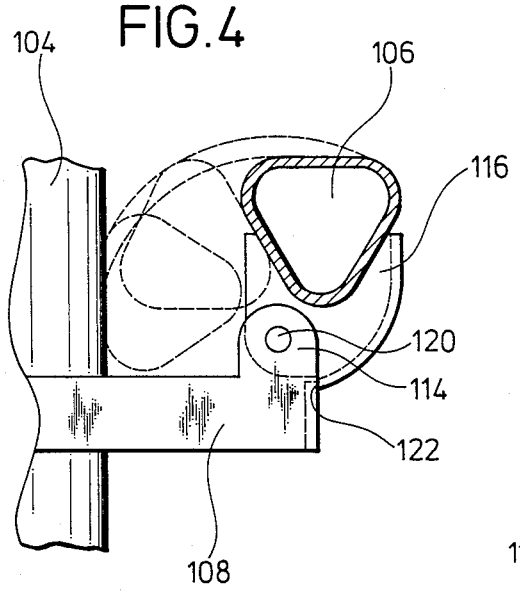
FIG. 4 is a front view illustrating the state of the rotation of the support piece for FIG. 2.
Figure 5:
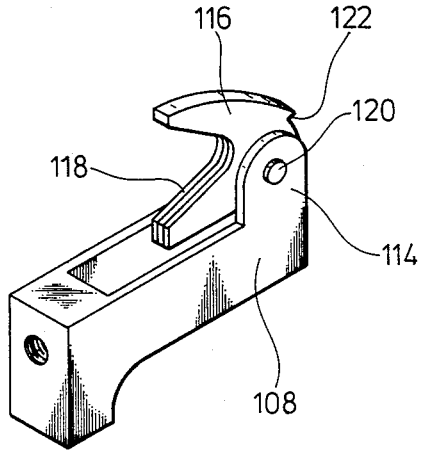
FIG. 5 is a perspective view for the support piece indicated in FIG. 4.

In actual application, several arm pieces 108 with prescribed length are set on the frame board 102 in the direction along the movable pipe 106. Each support piece 116 having the supporting section 118 is placed so that the supporting section orients upwardly. Then, the movable pipe 106 is put into the set of support pieces 116, and finally, as shown in FIG. 4, the movable pipe 106 is rotated together with the support pieces 116 by rotational force exerted toward the frame board 102. In the other procedure, each support piece 116 is put to orient toward the frame board 102, the corner section of the movable pipe 106 is put into the upper gap between the support piece 116 and the fixed pipe 104, and the movable pipe 106 is pushed up against the support piece 116, with ready introduction of the corner section of the movable pipe 106 into the supporting section 118. Even in case distortion of the frame board 102 causes irregular positioning of some of the fixed pipes 104, application of an extremely slight force on the movable pipe 106 will push back the forward-projecting fixed pipes 104 so that the movable pipe 106 may be held stable with its vertical plane in contact with the ridge line of the fixed pipe 104.

As seen from the above description, the support piece 116 need not always be rotated 90° as shown in FIG. 4, since the movable pipe 106 may be applied without the support piece 116 having been rotated up to the lateral position.

Application of concrete will exert pressure on the movable pipe 106, but will be unable to produce any rotational moment about the rotary shaft 120, since the lower contact-end position A of the movable pipe 106 is located on the same level as the position B of the rotary shaft 120, i.e., the concrete pressure is designed to pass through the rotary shaft 120.

Detachment of the movable pipe 106 may be effected by holding the movable pipe 106 by hand and applying force to rotate the pipe 106 together with the support piece 116 away from the frame board 102. In this process, the lower contact-end position A of the movable pipe 106 on the contact ridge of the fixed pipe is allowed to rotate gradually away from the fixed pipe 104, thus facilitating the detachment without applying any special force.

When the frame board 102 is so distorted backward as to produce gaps between the fixed pipe 104 and movable pipe 106, the support piece 116 sometimes goes farther downward over the specified position. In such cases, the upper corner section on the triangular cross section of the movable pipe 106 will get into contact with the fixed pipe 104 and the concrete, when put into the opposite side of the frame board 102, will push the fixed pipe 104 to the specified position until the movable pipe 106 has been rotated.

On the other hand, when the frame board 102 is distorted forward with the fixed pipe 104 in a slightly disengaged position, rotation of the movable pipe 106 together with the support piece 116 toward the fixed pipe 104 will cause the lower corner section of the triangular cross section of the movable pipe 106 to get into contact with the fixed pipe 104 at a slightly upper position than the specified position and further rotation will allow the movable pipe 106 to push back the fixed pipe 104 for correcting the distortion of the frame board 102 until it gets settled stable in the specified position. In this process, the movable pipe 106 held by hand is brought under a self-rotary force so that the support piece 116 is allowed to rotate toward the frame board 102. Therefore, as described above, an extremely slight force is required for the fixed pipe 104 to be pushed back to fast fixation.

As for the shape of the movable pipe 106, it is generally required that the movable pipe 106 should come into contact with the frame board or fixed pipe 104 by a definite plane and that the movable pipe 106 should have at least two contact points in its cross-sectional shape; detailed description will be given later. It should be noted that the movable pipe 106 may be of round pipe if provided with suitable stopper sections.

As for the cross-sectional shape of the fixed pipe 104, general round pipes, square pipes, etc. as well as triangular pipes with rounded corners may be used as the fixed pipe 104, as seen from the above description.

More detailed description for the level of the rotary shaft 120 is made. Theoretically, the rotary shaft 120 should be provided on the level B which is flush with the lower contact-end position A, on the fixed pipe 104, of the movable pipe 106. However, the rotary shaft 120 may be provided on a level a little lower than the level B, since the movable pipe 106 may be held with stability under a range of conditions which depend on both the mutual relation between the rotational moment by the total weight of the movable pipe 106 and support piece 116 and the frictional contact force between the fixed pipe 104 and movable pipe 106.

On the other hand, the rotary shaft 120 should not be positioned on any higher levels than the level B. This is because the support piece 116 would be unable to be rotated in the disassembling work after solidification of the concrete applied, since the distance between the lower contact-end position A of the movable pipe 106 and the rotary shaft would be longer than the distance between the fixed pipe 104 and the rotary shaft 120.

Figure 6:
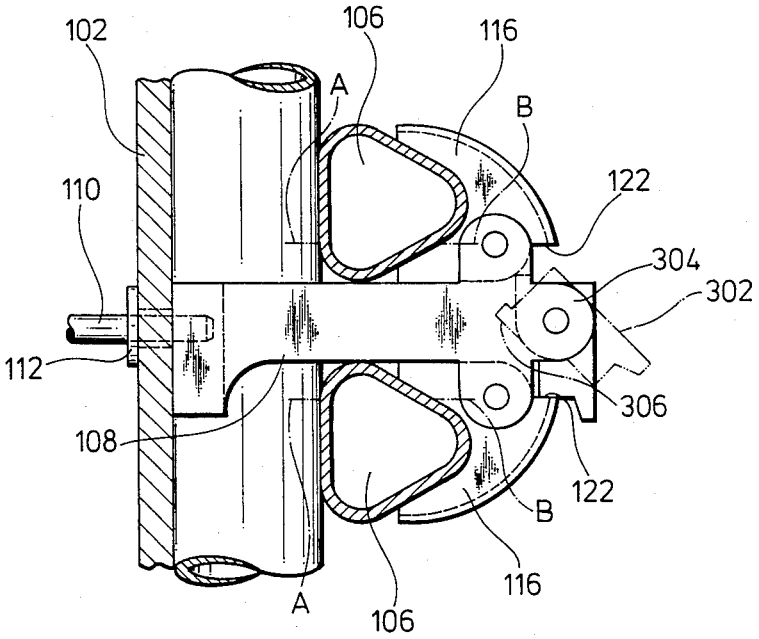
FIG. 6 is a front view illustrating another example of holding tool.

FIG. 6 illustrates another application example. The arm piece 108 has a pair of bearings 114 projected upward and downward from both sides of its rear end, respectively each bearing 114 having the support piece 116 provided, and two movable pipes 106 are applied on each side of the arm piece 108. With this structure as it is, the lower support piece 116 with the movable pipe 106 applied would get disengaged by their own weights, for which a lock mechanism is to be provided with the support piece 116 as follows.

In the lock mechanism, the approximately rectangular rotary piece 302 is provided to rotate freely on a rotary shaft 304 located on the reat-end edge of the arm piece 108. A projected edge 306 is provided to the side of frame board 102 on the upper-end edge of the rotary piece 302, and the lower-end edge of the lower support piece 116 is designed to be caught and locked by a stopper 122 on the lower support piece 116. The upper support piece 116, when rotated outward, will cause the stopper 122 on the upper support piece 116 to push the projected edge 306 to rotate the rotary piece 302, thus releasing the lower support piece 116 from locking.

The mechanism, in which a pair of support pieces 116 is situated on the arm piece 108, is applicable to such systems as hold the movable pipe 106 laterally. In such cases, each support piece 116 is required to be provided with a lock mechanism.

The setting of a pair of support pieces 116 has the following advantages: excellent stability, no unfavorable force onto the screwed connection between the spacer 110 and the arm piece 108, and availability of pipes of low strength and light weight for the movable pipe 106.

Figure 7:
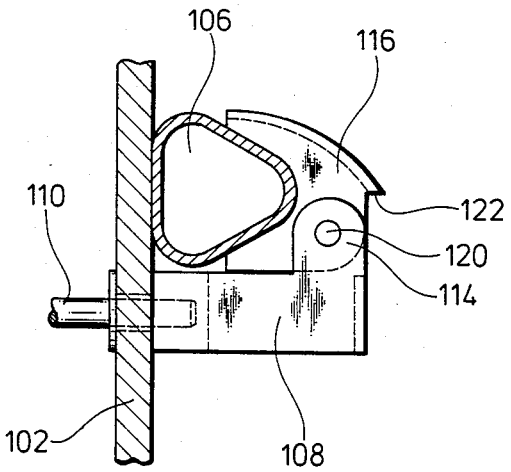
FIG. 7 is a front view showing a state in which a long reinforcing material is fixed directly on the outer surface of frame board.

FIG. 7 illustrates an application example in which the movable pipe 106 is designed to get into direct contact with the frame board 102 and which is applicable to the reinforcement of beam-type frames, etc. The job on these parts, which is to be done, for example, after completion of setting beam iron supports, is obliged to be conducted just before concrete application and on spots inconvenient for working. This application example facilitates rapid and ready application of framing materials.

Figure 8A:
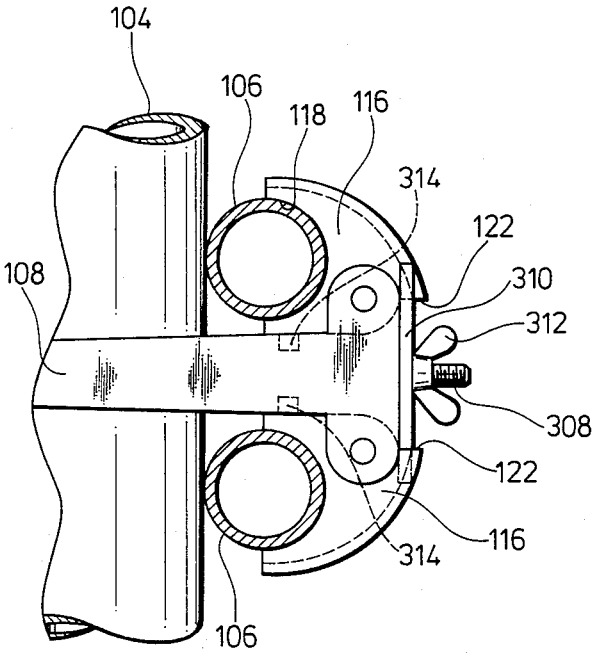
FIG. 8(*a*) is a front view of another example.
Figure 8B:
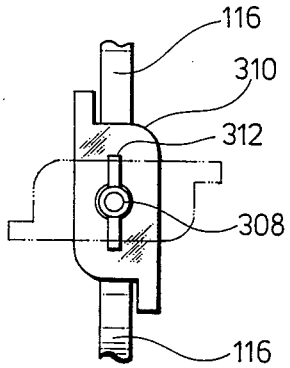

Another example of lock mechanism is shown in FIGS. 8(*a*) and 8(*b*), where the rear end of the arm piece 108 has a screwed piece 308 projected outward therefrom. A rectangular-plate stopper piece 310 is put, at its center, into the screwed piece 308, and the stopper piece 310 is fixed between a thumbscrew 312 and the rear end of the arm piece 108. The setting of the movable pipe 106 onto the supporting section 118 of the support piece 116 is effected as follows: With the longer ridge of the stopper piece 310 faced with the stopper 122, the stopper 122 and the longer ridge of the stopper piece 310 are held out of engagement with each other, thus bringing the support piece 116 into free state; the support piece 116 is then rotated away from the fixed pipe 104 to insert the movable pipe 106 into the supporting section 118; the support piece 116 is rotated toward the fixed pipe 104 to bring the movable pipe 106 into contact with the fixed pipe 104, in the same way as above; and finally, the stopper piece 310 is rotated and the thumbscrew 312 is applied when the shorter ridge of the stopper piece 310 has been caught by the stopper 122.

In this case, the shorter ridge of the stopper piece 310 prevents completely the rotation of the support piece 116. Therefore, the contact section on the movable pipe 106 and the rotary shaft on the support piece 116 need not always be flush with each other, as the above application example requires. Such a positional relation, shown in FIGS. 8(*a*), 8(*b*) is effective to allow the load of concrete to yield a moment which causes the support piece 116 to rotate away from the fixed pipe 104.

As shown in FIGS. 8(*a*), 8(*b*), a stopper 314 may be provided which restricts the rotation of the support piece 116 toward the fixed pipe 104 so as to bring the movable pipe 106 into contact with the most suitable position on the fixed pipe 104. In this case, a round pipe, which contacts with the fixed pipe 104 at one point, may be employed as the movable pipe 106; when the contact position has been set flush with the rotary shaft on the support piece 116, i.e., the center of the round pipe and the center of the rotary shaft has been set on the same horizontal level, the round pipe will be prevented from further rotating down ward unless, as previously mentioned, the frame board is bent backward.

The above-described example structure enables a very slight force to effect the setting of reinforcing pipes on the frame board and their detachment only through the simple operation of rotation on the movable pipe, is so simple as to be produced at a low cost with resulting reduction in work cost, and is effective for getting concrete finish of such a uniformity and precision as to eliminate appearance correction with mending cost.

FIGS. 9, 10, 11, and 12 show other application examples. Since these application examples are different from the above-described examples only in the shape of a supporting section 68 of a support piece 64 and a stopper 82, the other parts will be indicated by the same symbols and will be given no description.

Figure 11:
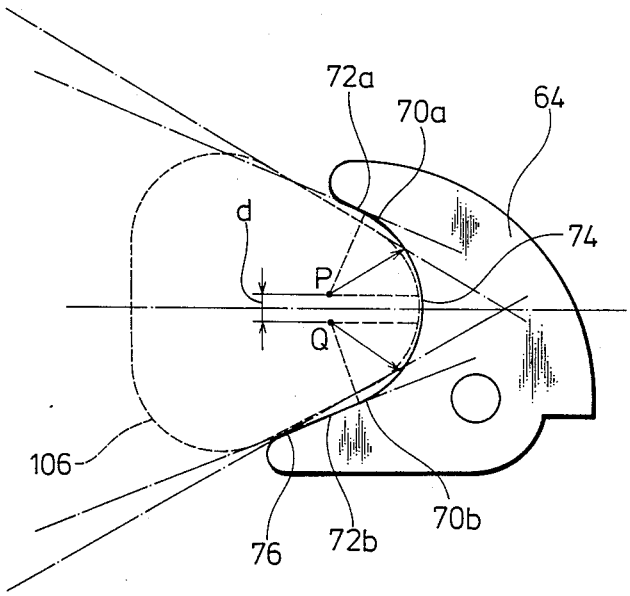
FIG. 11 is a front view of the support piece.

The shape of the supporting section 68 is evident from FIG. 11. The section 68 contains two arc sections 70*a* and 70*b*, which possess the center points P and Q positioned with a vertical interval of d, a central angle of 60°, and the same radius with the corner section of the movable pipe 106 in the form of triangular pipe. The linear sections 72*a* and 72*b* are formed by the tangents each drawn at the ends of the arc sections 70*a* and 70*b*, and the large arc section 74 (may be linear) is formed so as to connect the ends of the arc sections 70*a* and 70*b*. The lower linear section 72*b* is longer than the upper linear section 72*a* and at the end of the section 72*b* there is the slant section 76 tilting at 7.5° with respect to the linear section 72*b*.

Figure 9:
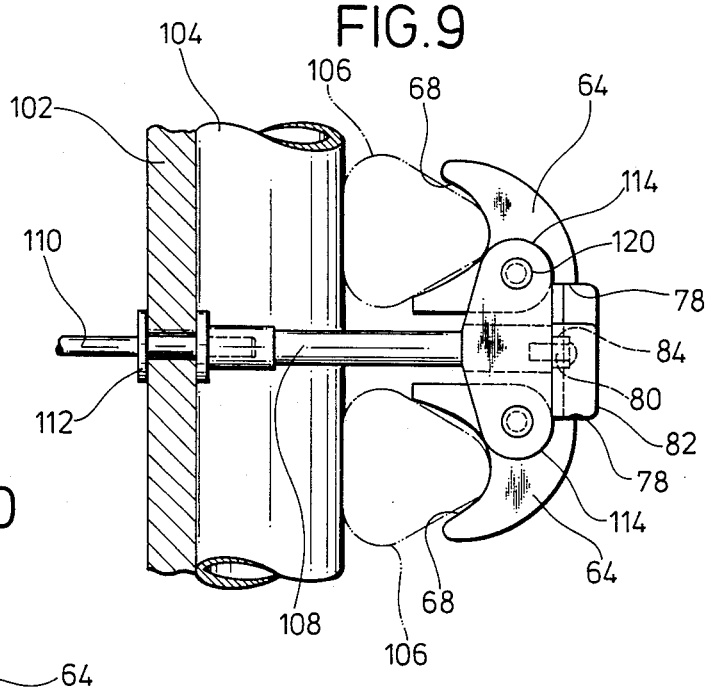

In FIG. 9, 78 is a catching section, which projects away from the supporting section 68 in the support piece 64 and which is in contact with the shorter side of a triangular stopper 82, attached on a shaft 80 at the rear end of the arm piece 108 for allowing free rotation in the plane vertical to the axis line of the arm piece 108. This stopper 82 prevents the upper and lower support pieces 64 from rotating away from the frame board 102.

Figure 10:
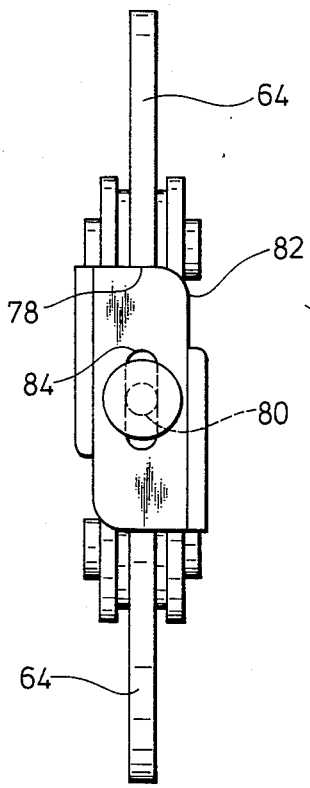
FIG. 10 is a side view.

A shaft hole 84 on the stopper 82, to hold the shaft 80, is, as shown in FIG. 10, formed in a elongated hole along the longitudinal direction. The upper and lower support pieces 64 can rotate in opposite directions with a definite relation with each other by moving up and down within the shaft hole 84 with the shorter side of the stopper 82 kept in contact with the catching section 78.

The application example described above is effective in cases where distortion of the frame board 102, the accuracy in drill boring work, etc. cause the position where the spacer 110 projects, to vary in horizontal location on the outer wall of the frame board 102. Actual field work will usually produce an error about 2 cm in horizontal location. Arm pieces 108 are screwed on the ends of spacers 110 arranged to vary in horizontal location and their support pieces 64 are rotated upward. Then a corner of the triangular pipe 106 is inserted into the supporting section 68 on each support piece 64 and twisted so that the triangular pipe 106 is caused to rotate toward the frame board 102. This operation will allow the triangular pipe 106 to be fixed in contact with the outer surface of the vertical pipe 104 under practical restriction by the holding tools located in the middle between the upper and lower positions in different heights. The peak of one corner section of the triangular pipe 106 has been brought into contact with the center of the supporting section 68, i.e., the center of the large arc section 74 and the flat section of the triangular pipe 106 near the arm piece 108 are supported in contact with the slant section 76 of the supporting section 68 (at least the slant section 76 is designed to fulfil such an orientation).

Figure 12:
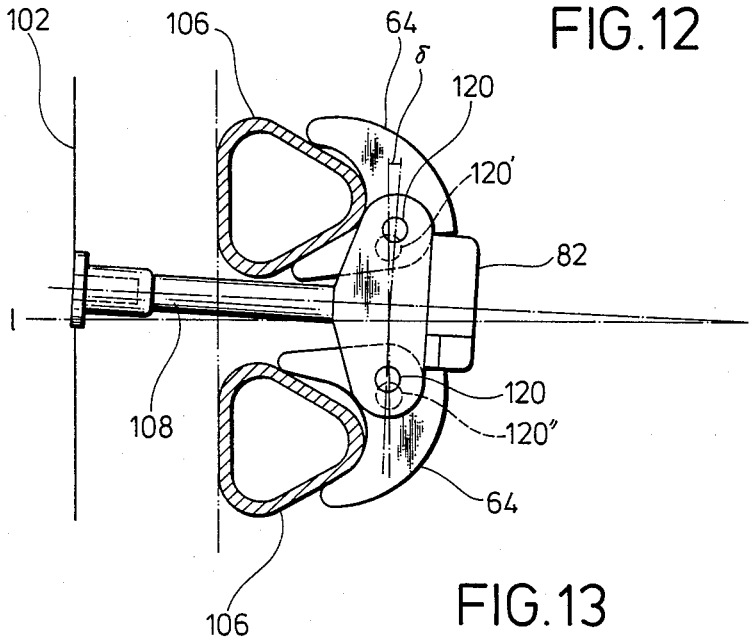
FIG. 12 is a frontview of a state of a long reinforcing material fixed.

On the other hand, such a holding tool as is oriented away from the midddle position, say 1 cm upward, has, as shown in FIG. 12, its tip pushed down by the upper triangular pipe 106 via the support piece 64 and the arm piece 108 has its axis line tilted at an angle of about 2.5° with respect to the perpendicular l.

In addition, the upper rotary shaft 120 is caused to shift upward and backward by δ from the upper rotary shaft 120' of the holding tool located at the middle position indicated by the imaginary line, and the upper support piece 64 is caused to rotate further toward the frame board 102 than the support piece of the holding tool located at the middle position, until the arc section 70*b* and linear section 72*b* are brought into contact with their corresponding lower surfaces of the triangular pipe 106. Thus, the triangular pipe 106 is fixed.

The lower rotary shaft 120 is caused to shift upward and forward by δ from the lower rotary shaft 120" of the holding tool located at the middle position indicated by the imaginary line, and the lower support piece 64 is caused to rotate by a smaller angle toward the frame board 102 than the support piece of the holding tool located at the middle position, until the arc section 70*a* and linear section 72*a* are brought into contact with their corresponding lower surfaces of the triangular pipe 106 and into the upper surface of the triangular pipe 106 near the tip of the linear section 72*b*. Thus, the lower triangular pipe 106 is fixed. In this process, the excess rotary angle of the upper support piece 64 is almost equal to the reduced rotary angle of the lower support piece 64, and the interval between the catching section 78 of the upper support piece 64 and the catching section 78 of the lower support piece 64 is the same as that for the tool located at the middle position; thus, the upper and lower support pieces may effectively be fixed by allowing the stopper 82 to move upward by a required distance along the stretched shaft hole 84.

Above has been dealt with a case where the holding tool is in upward deviation; in cases of downward deviation, a similar relation, with the upper and lower positions reversed, is applicable and the same effect is available.

When the holding tools deviate from the middle position slightly within 1 cm, the slope of the arm piece 108 with respect to the frame board 102 after application of the triangular pipe 106 is smaller than in the above case. Also in such cases, e.g., when the holding tools deviate upward from the middle position, the upper support piece 64 comes into contact with both the approximately middle position of the supporting section 68 and the boundary line between the linear section 72*b* and the slant section 76, resulting in fixation of the triangular pipe 106.

On the other hand, the support piece 64 also comes similarly into contact with both the approximately middle position of its supporting section 68 and the boundary line between the linear section 72*b* and the slant section 76, resulting in fixation of the triangular pipe 106.

Figure 13:
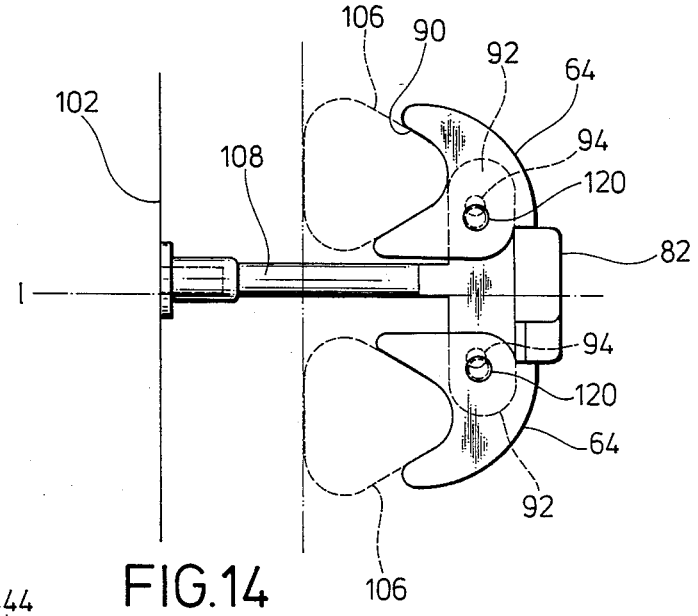
FIG. 13, showing another application example, is a front view of a state in which a long reinforcing material is fixed.

FIG. 13 shows another application example. The same parts with the above-described application example will be indicated by the same symbols and given no description.

In this application example, a supporting section 90 of the support piece 64 is in a form of arc fitting to one corner of the triangular pipe 106; the rotary shaft 120 is fixed on the support piece 64 and penetrates a shaft hole 94, which is provided on a single-plate bearing 92 penetrating the support piece 64 and which is extended in the direction vertical to the arm piece 108; and the support piece 64 is designed to be capable of rotation about the rotary shaft 120 and of free movement along the elongated shaft hole 94.

With the application example having the above-described structure, the triangular pipe 106 may be kept inserted in the supporting section 90 even when holding tools have been set on the outer wall of the frame board 102 with a more or less varied in level, since, as shown in FIG. 13, the support piece 64 may be allowed to shift as the upper and lower triangular pipes 106 come to be positionally fixed under the restriction by the holding tool located at the middle position. Also in this case, the stopper 82 can effectively work since the interval between the upper and lower support pieces 64 is the same as that for the holding tool located at the middle position.

Also in this application example, formation of the supporting section 90 in a form similar to those adopted in the application examples shown in FIGS. 9–12 permits the holding of the triangular pipe 106 at suitable rotary positions of the support piece 64 as in the application examples shown in FIGS. 9–12, as well as the vertical movement of the support piece 64. Therefore, even if arm pieces 106 are different from one another in the magnitude of slope, the support piece 64 is allowed to move properly so as to be kept in plane contact with the triangular pipe 106, thus allowing the support of the triangular pipe 106 to be supported securely under a wide range of conditions.

As is evident from the above description, this application example may effectively be employed even when the arm pieces are fixed on the outer wall of the frame board with a more or less difference in level, since this application example is capable of making the level difference so ineffective that the reinforcing pipes may be held fast.

FIGS. 14–18 show other application examples of arm pieces.

A description will first be made, by use of FIG. 14, of a spacer 440 which is to be used with the arm piece 106.

Figure 14:
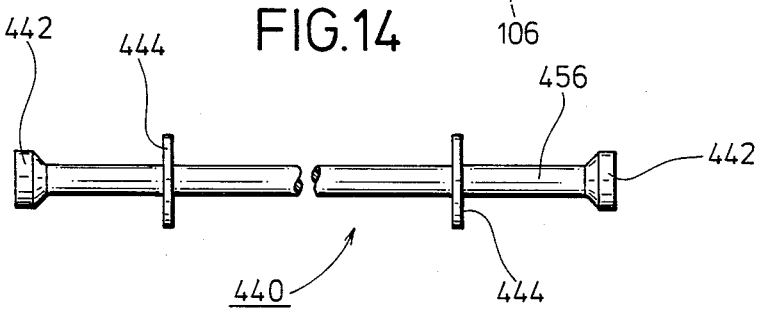
FIG. 14 is a front view of a spacer.

As shown in FIG. 14, the spacer 440 is in a form of bar, and has enlarged sections 442 with inward-descending tapers, and the flange sections 444 inside the enlarged sections 442.

Figure 15:
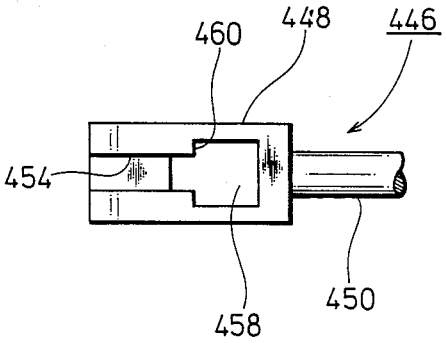
Figure 16:
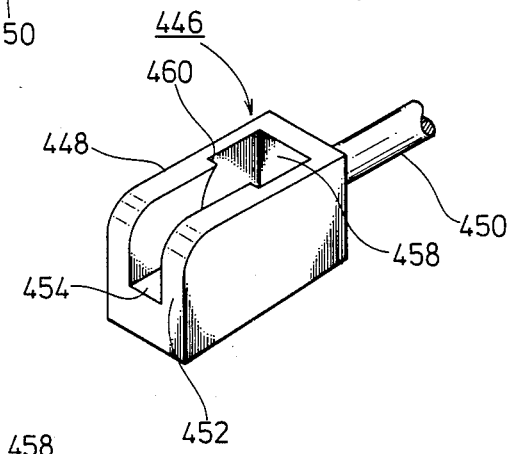
FIG. 16 is a perspective view.
Figure 17:
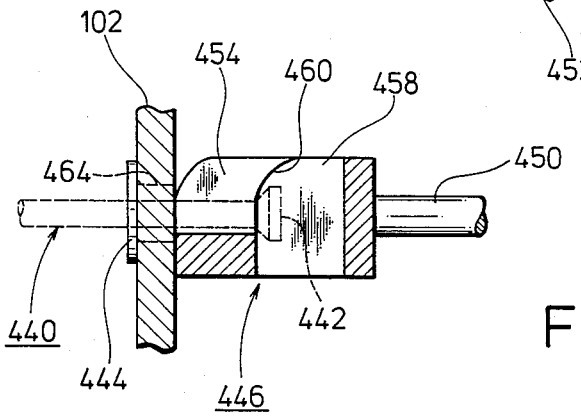
FIG. 17 is a cross-sectional view.

FIGS. 15 and 16 show an arm piece. The arm piece 446 has in its front section a catching section 448 and in its rear section an arm 450 in a form of straight line; the rear end of the arm 450 is provided with a bearing section, etc. as in the above-described application examples.

Next the catching section 448 will be described. The catching section 448 has its front wall 452, to contact with the frame board, formed vertical to the axis line of the arm 450 and its top section curved backwardly from the wall 452.

454 is a first concave section, which is open to the front wall 452 and top plane of the catching section 448 and which is designed so that the small-diameter section 456 between the enlarged section 442 and flange section 444, of the spacer 440 is inserted thereinto.

458 is a second concave section, which, following the first concave section 454, is open to the top plane of the catching section 448, with a longer width than the first concave section 454 and into which the enlarged section 452 of the spacer 440 is inserted when the small-diameter section 456 of the spacer 440 enters the first concave section 454.

The top section of a stepped wall 460 between the first and second concave sections, 454 and 458, is curved to extend backwardly, radius of curvature being the same as that of the arc section of the front wall 452. The inner bottom plane of the second concave section 458 is deeper than that of the first concave section 454 or the second concave section 458 penetrates the catching section 448 vertically. The lower plane of the enlarged section 442 of the spacer 440 does not come into contact with the inner bottom plane of the second concave section 458 when the small-diameter section 456 of the spacer 440 has entered the first concave section 454 to get flush with the arm 450.

The distance between the lower section of the front wall 452 and the lower section of the stepped wall 460, plus the thickness of the frame board, is designed to be equal to or a little longer than the distance between the flange section 444 of the spacer 440 and the part of the enlarged section 442 in contact with the stepped wall 460.

This application example has the above-described structure.

Next, the attachment of the arm piece 446 to the spacer 440 is explained.

Figure 18:
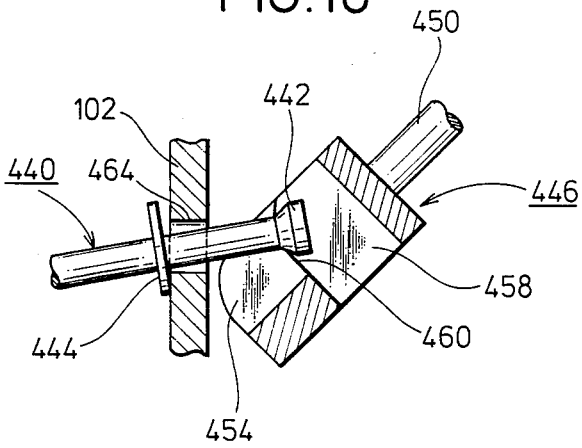
FIG. 18 is a cross-sectional view illustrating the connection to the spacer.

First, holes 464 are bored at prescribed intervals on the frame board 102 previously set at prescribed positions. The spacer 440 is inserted into this hole 464 so as to let its enlarged section 442 project through the frame board 102. In this process, the spacer 440 will be slant as shown in FIG. 18, but it will not come out of the hole 64 because it is caught by the enlarged section 442.

Next, the catching section 448 of the arm piece 446 is applied so that the enlarged section 442 of the spacer is inserted into the top section of the second concave section 458 (may be inserted down to the lower section) and the arm piece is rotated in such a way that the catching section 448 is scooped up like a nail being drawn out with a nail puller.

The enlarged section 442 is guided downward along the arc section of the stepped wall of the first and second concave sections, 454 and 458, and simultaneously the sma11-diameter section 456 of the spacer 440 is guided into the first concave section 454. When the enlarged section 442 has reached the lower section of the stepped wall 460 with the small-diameter section 456 positioned horizontal, the lower section of the front wall of the catching section 448 is in contact with the frame board 102 and at the same time the frame board 102 is tightly held between the front wall 452 and the flange section 444, with both the spacer 440 and the arm piece 446 fixed fast vertically to the frame board 102. The detachment of the arm piece 46 after application of concrete may be effected in the above-described sequence of operations reversed.

Conspicuous effects obtainable from the structures specified by the above application examples are as follows:

(1) Labor may be reduced because one person may complete the operation and working time may be reduced to a great extent because the workability of the system is excellent as compared with the conventional method using screws.

(2) Since only the operation like applying a nail puller is required, application in any positions may be easily carried out.

(3) Only a slight force is needed for operation as in drawing out a nail with a nail puller, since both the front-end plane of the arm piece and the top section of the stepped wall are formed in slant planes.

The movable pipe 106 will be described in detail.

Those metal pipes, triangular with rounded corners, which have been adopted in the application examples having been described, are especially suitable as the movable pipe 106. This is because the triangular form fulfils the requirements that the movable pipe should have two contact points, with respect to the cross section, when put on the frame board 102 or the fixed pipe 104 applied onto the frame board 102, and that, in the loading on the supporting section 118, the movable pipe 106 should be prevented from rotating in its circumferential direction, and because of the capability to be easily introduced into the supporting section 118 and to be manufactured simply. The triangular pipe has advantages in that it may be laid on the ground with stability, also in cases it is used as the fixed pipe 104, it has a mechanical strength equivalent to that of the round pipe, and so on.

The requirements imposed on the movable pipe 106 are as follows:

1. It should be capable of contact with the frame board 102 or with the fixed pipe 104 at two points at least.
2. The movable pipe 106 and the supporting section 118 on the holding tool should be capable of being jointed with each other so that the support piece may rotate together when a twisting force is applied on the movable pipe 106 to cause rotation.
3. When a movable pipe 106 is inserted into the supporting sections 118 of many holding tools arranged on the wall of the frame board 102, the correction for the errors in the vertical positions and slopes of the support pieces 116 should be made without any unfavorable force.
4. The strength required for the movable pipe 106 should be possessed.

An examination of various long reinforcing materials, hitherto in use, on the basis of the above requirements has led to the following conclusions:

(1) Round pipe does not conform to the above requirements 1 and 2.

(2) Square steel pipe and rip channel steel are difficult, as will be described later, to be inserted into the supporting section 118 of the support piece 116, because of the above requirement 3.

The above requirement 3 is very important because it is inevitably involved in actual field work: Usually, drill boring for preparation of holes results in vertical deviation of about 1 cm, the hole receiving the male screw section at the tip of the spacer 110. When the arm piece 108 is arranged to be situated perpendicularly to the frame board 102, it is impossible to arrange all the arm pieces 108 in complete lateral alignment, i.e., they inevitably deviate both horizontally and vertically. The frame board 102 itself, which cannot be completely flat but more or less distorted, will cause the projected ends of the holding tools to get out of alignment.

One of the requirements imposed on the movable pipe 106 is that the pipe be capable of absorbing, or correcting for, the above-mentioned errors in positioning.

Another factor to be taken into account is that the angle of rotation, with which the support piece 116 gets away from the frame board 102, is most suitably about 45°, with which a slight force may, after the insertion of the movable pipe 106 into the support piece 116, give the movable pipe 106 a self-revolving force to let it rotate toward the frame board 102, although easier insertion of the movable pipe 106 requires an angle about 90° : When the angle is large, the self-revolving force applied to the movable pipe 106 acts not as a force pushing the movable pipe 106 forward but as a force rotating the support piece 116 backward: The position of the lower support piece 116 depends on the positional relation between its center of gravity and the rotary shaft. For the shape shown in FIG. 4, the angle concerned is about 30°, with difficulty in inserting the movable pipe 106 into the lower support piece 116.

Figure 19:
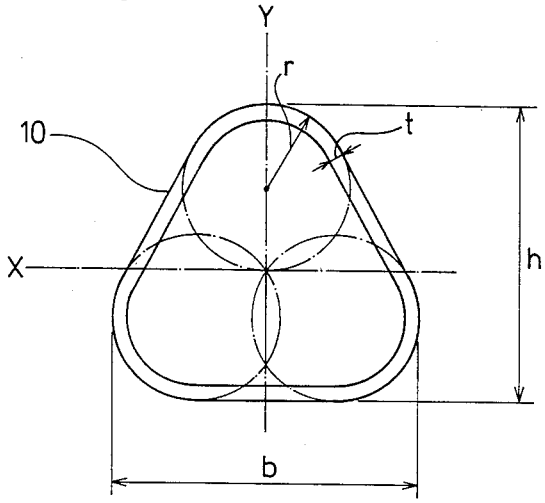
FIGS. 19 and 20 are side views for other application examples of long reinforcing materials.

As described above, the holding tools arranged laterally at prescribed intervals will project with different angles and positions of their ends, resulting in the supporting sections 118 extending into various directions as viewed laterally, and the support pieces 116 are caused to be set with comparatively small angles of rotation. Hence, it is difficult to insert into the prescribed supporting sections conventional square steel pipe and rip channel steel which have 90° angles between component planes. On the contrary, the triangular pipe (see FIGS. 19 and 20) which consists of planes making an acute angle of 60°, may first have its end part easily inserted into the supporting section 118 and a subsequent rotation is possible to absorb the above positional unevenness.

When the support piece 116 has been rotated maximally toward the frame board 102, the setting of the movable pipe is in the long run possible by first inserting the end part of the triangular pipe 10 into a small gap between the top part of the support piece 116 and the fixed pipe 104 and then forcing the end part to be twisted up.

Such triangular pipes as have corner parts of acute angle are inadequate as the triangular pipe 10 because of the following disadvantages: they have a low bending strength at their corner parts; size must be increased in order to have enough strength as the reinforcing material so that the cost will be increased, the weight will be too much for handling, corner parts are apt to be damaged during delivery work, and it is difficult to manufacture; the formation of the corner part with acute angle is irrational in view of the operation in which the above-described holding tools are used to subject the pipe to circular movement.

Tables 1 and 2 give information on the relation, under the condition of the same height and thickness, between the size of the corner-part arc section of the triangular pipe 10 and the cross-sectional performance with respect to the X axis.

TABLE 1 h = 49 mm t = 2.3 mm

| | ③ (mm) | ④ | ⑤ A (cm²) | ⑥ W (kg/H) | ⑦ I (cm⁴) | I/A |
|---|---|---|---|---|---|---|
| ① | r = 4 | 1.090 | 3.678 | 2.887 | 9.34 | 2.54 |
| | r = 6 | 1.082 | 3.648 | 2.864 | 9.52 | 2.61 |
| | r = 8 | 1.073 | 3.619 | 2.841 | 9.66 | 2.67 |
| | r = 10 | 1.064 | 3.589 | 2.817 | 9.76 | 2.72 |
| | r = 11 | 1.060 | 3.574 | 2.806 | 9.80 | 2.74 |
| | r = 12 | 1.055 | 3.559 | 2.794 | 9.82 | 2.76 |
| | r = 13 | 1.051 | 3.544 | 2.782 | 9.839 | 2.78 |
| | r = 14 | 1.046 | 3.529 | 2.770 | 9.842 | 2.79 |
| | r = 15 | 1.042 | 3.514 | 2.758 | 9.83 | 2.80 |
| | r = 16 | 1.037 | 3.499 | 2.747 | 9.82 | 2.81 |
| | r = 17 | 1.033 | 3.484 | 2.735 | 9.79 | 2.81 |
| | r = 18 | 1.029 | 3.470 | 2.724 | 9.75 | 2.81 |
| | r = 19 | 1.024 | 3.455 | 2.712 | 9.70 | 2.81 |
| | r = 20 | 1.020 | 3.440 | 2.700 | 9.64 | 2.80 |
| | r = 22 | 1.011 | 3.410 | 2.677 | 9.48 | 2.78 |
| ② | r = 24.5 | 1.0 | 3.373 | 2.648 | 9.22 | 2.73 |

① Triangular pipe
② Round pipe
③ Radius
④ Ratio of circumferential lengths
⑤ Cross-sectional area
⑥ Weight
⑦ Cross-sectional secondary moment

TABLE 2 h = 49 mm t = 2.3 mm

| | ③ (mm) | ④ Z (cm³) Z1 | Z2 | Z/A Z1/A | Z2/A | ⑤ b (mm) | b − h (mm) | ⑥ C (mm) |
|---|---|---|---|---|---|---|---|---|
| ① | r = 4 | 2.98 | 5.29 | 0.81 | 1.44 | 55.34 | 6.34 | 47.34 |
| | r = 6 | 3.10 | 5.19 | 0.85 | 1.42 | 54.72 | 5.72 | 42.72 |
| | r = 8 | 3.22 | 5.08 | 0.89 | 1.404 | 54.11 | 5.11 | 38.11 |
| | r = 10 | 3.33 | 4.98 | 0.93 | 1.39 | 53.49 | 4.49 | 33.49 |
| | r = 11 | 3.38 | 4.90 | 0.95 | 1.37 | 53.18 | 4.18 | 31.18 |
| | r = 12 | 3.43 | 4.83 | 0.96 | 1.36 | 52.87 | 3.87 | 28.87 |
| | r = 13 | 3.47 | 4.76 | 0.98 | 1.34 | 52.56 | 3.56 | 26.56 |
| | r = 14 | 3.51 | 4.69 | 0.99 | 1.33 | 52.25 | 3.25 | 24.25 |
| | r = 15 | 3.55 | 4.62 | 1.01 | 1.31 | 51.94 | 2.94 | 21.94 |
| | r = 16 | 3.59 | 4.53 | 1.03 | 1.29 | 51.63 | 2.63 | 19.63 |
| | r = 17 | 3.62 | 4.45 | 1.04 | 1.28 | 51.32 | 2.32 | 17.32 |
| | r = 18 | 3.66 | 4.37 | 1.05 | 1.26 | 51.01 | 2.01 | 15.01 |
| | r = 19 | 3.68 | 4.28 | 1.07 | 1.24 | 50.70 | 1.70 | 12.7 |
| | r = 20 | 3.71 | 4.19 | 1.08 | 1.22 | 50.39 | 1.39 | 10.39 |
| | r = 22 | 3.74 | 4.01 | 1.10 | 1.18 | 49.77 | 0.77 | 5.77 |
| ② | r = 24.5 | 3.76 | | 1.11 | | 49.0 | 0 | 0 |

① Triangular pipe
② Round pipe
③ Radius
④ Cross-sectional coefficient
⑤ Width
⑥ Linear section Before analyzing the data of Tables 1 and 2, the requirements for the triangular pipe 10 wi11 be considered:

(1) High strength and low weight are required.

(2) The necessary insertion of the corner part of pipe into a small gap prefers a smaller arc section (radius r), but smaller difference between height (h) and width (b) facilitates the twisting operation for final setting of the pipe.

(3) The rotary shaft 120 of the support piece 116 should be positioned at the boundary between the linear part (C) and arc section of the triangular pipe 10. Therefore, it is better to make shorter the length between the boundary and the lower end of the arc section in order to make the entire holding tool lighter by minimize the length of the arm of the bearing 114 of the support piece 116. For the reduction in weight of the support piece 116, since the support piece 116 should be on the center axis line, it is better to make shorter the distance between the axis and the center axis line, i.e., the distance between the center of the triangular pipe 10 and the boundary of the arc section.

(4) Longer linear sections are better for the stability of the triangular pipe 10.

(5) Larger arc sections are better for the easiness of the handling.

First, an examination will be made on the strength specified in (1) above. A requirement for the reinforcing material for the frame board is high bending strength, which calls for two conditions: one is that the internal stress shall not exceed its allowable limit for bendings applied and the other is that, for bendings applied, the material shall not exceed the limit allowable for the section under the action of the bending.

The former is related to "cross-sectional coefficient Z" and the latter to "cross-sectional secondary moment I". The larger the value of each factor, the harder the bending.

Strength of reinforcing materials should always be checked in these two points and designs should be made in conformity with both the requirements. Let us first examine on the cross-sectional secondary moment I. As is evident from Table 1, the moment shows the highest value when the radius of the arc section r=14 mm, exceeding any values for round pipes; the cross-sectional area (weight), however, is large as compared with round pipes. The cross-sectional secondary moment per unit cress-sectional area is large, i.e., r=16–19 mm, only slightly smaller than that for round pipes. These imply that, to supply pipes of the same height under the condition of a constant thickness, triangular pipes require longer circumferential lengths than round pipes and accordingly they require larger cross-sectional areas. In this case, however, triangular pipes have larger cross-sectional moment I than round pipes, the largest value being shown in r=14 mm for the conditions: height h=49 mm and thickness t=2.3 mm; however, note that, for these examples, the cross-sectional moment I per unit area is highest at r=16–19 mm.

Next, let us examine on the cross-sectional coefficient Z. In the case of triangular pipes, the center of gravity is located at one third the height and the cross-sectional coefficient Z differs in value between the locations of top and bottom. Since application of a high bending stress will lead to breakage of the top section even if Z for the bottom section is very large, Z for the top section is important in such a case. As the form approaches a circle, Z for the top increases and Z for the bottom decreases. Thus, from Z only, it may be considered that the closer the form is to circle, the better. However, many cases of strength calculations for ordinary reinforcing materials are encountered with the relation that strength is good, whereas bending is too much, hence it follows that Z need not be so much higher than required and that use of high-strength materials wi11 be of advantage for Z.

Increase in strength of the material will not change the bending and the important point lies in increasing the cross-sectional secondary moment I. Therefore, the condition obtainable on the basis of cross-sectional coefficient Z is that selection shall be made for the material which has the necessary, least value of Z.

Next, let us examine on condition (2). That the difference between height and width is small corresponds to that the difference b-h is sma11 in Table 2; this difference becomes smaller as the form approaches a circle. However, condition (2) is in contradiction to the requirement that smaller values of r are better for the insertion of the top section. A reconcilement based on fulfillment of both the conditions leads to the condition r=12–13 mm.

Next, let us examine on condition (3). Condition (3) is equivalent to the simultaneous fulfillment of the following two conditions:

[1]$b/2-c/2=(b-c)/2=r$ shall be small.

[2]$c/2$ shall be small.

For [1], smaller value of r is better and for [2], larger value of r is better. The condition satisfying both [1] and [2] is $r=c/2$ when $(b-c)/2=c/2$, which is best satisfied by r=13 mm.

Conditions (4) and (5) are opposite in effects to each other. A reconcilement based on fulfillment of both the conditions leads to the condition r=ca. 12–13 mm.

Figure 20:
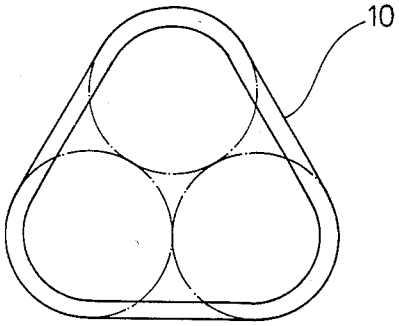

Each condition has been examined. For conditions (1) and (3) r=14 and 13.3 mm may be regarded as most effective, respectively. These values of r satisfy all the other conditions (2), (4), and (5). Let us consider the shape of pipe under the condition of h=49 mm: r=14 mm corresponds to a shape where each circle composed of the extension of the corner arc of the triangular pipe 10 has a diameter equal in length to the distance between the center of circle and the peak point of each corner; r=13.13 corresponds to a shape where, as shown in FIG. 20, the three circles each comprising each corner arc are in external contact with one another and at the same time in internal contact with the circle which is in external contact with the triangular pipe 10.

Optimum values of r have been obtained, but practically applicable values are not restricted to these values.

Figure 21:
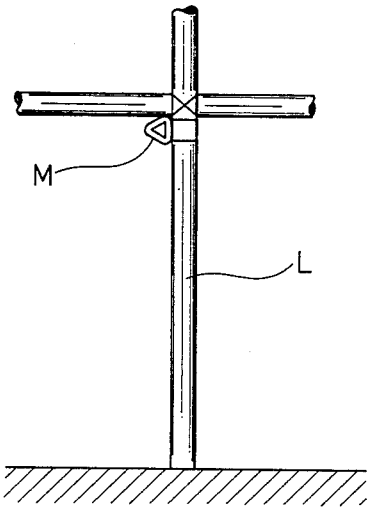
FIG. 21 shows a use of the long reinforcing material as a scaffold for construction work.

Now, application to scaffolds for construction work will be discussed. The requirement for scaffold materials is that no breakage shall occur in application as the vertical pipe L shown in FIG. 21, i.e., the cross-sectional secondary radius $i=\sqrt{I/A}$ shall be large, and that, in use as the lateral pipe M, strength shall be high with more or less bending permissible, i.e., the cross-sectiona1 coefficient Z (the cross-sectional coefficient in the X-axis direction for the case shown in the figure) shall be large.

Table 3 lists the cross-sectional performance with respect to the Y axis.

TABLE 3

| | ③ (mm) | ④ I ($cm^4$) | I/A | h = 49 mm t = 2.3 mm ⑤ 23 ($cm^3$) |
|---|---|---|---|---|
| ① | r = 4 | 9.34 | 2.54 | 3.375 |
| | r = 6 | 9.52 | 2.61 | 3.480 |
| | r = 8 | 9.66 | 2.67 | 3.571 |
| | r = 10 | 9.76 | 2.72 | 3.649 |
| | r = 11 | 9.80 | 2.74 | 3.686 |
| | r = 12 | 9.82 | 2.76 | 3.715 |
| | r = 13 | 9.839 | 2.78 | 3.74 |
| | r = 14 | 9.842 | 2.79 | 3.77 |
| | r = 15 | 9.83 | 2.80 | 3.79 |
| | r = 16 | 9.82 | 2.81 | 3.804 |
| | r = 17 | 9.79 | 2.81 | 3.815 |
| | r = 18 | 9.75 | 2.81 | 3.823 |
| | r = 19 | 9.70 | 2.81 | 3.826 |
| | r = 20 | 9.64 | 2.80 | 3.826 |
| | r = 22 | 9.48 | 2.78 | 3.81 |
| ② | r = 24.5 | 9.22 | 2.73 | 3.76 |

① Triangular pipe
② Round pipe
③ Radius
④ Cross-sectional secondary moment
⑤ Cross-sectional coefficient As is evident from Table 3, triangular pipes have longer cross-sectional secondary radii at $r > 11$ mm and larger cross-sectional coefficients at $r > 14$ mm than the round pipe.

Triangular pipes may be used as materials for support and maintenance in addition to scaffolds for construction work. All the above descriptions have used hollow pipes, but it of course goes without saying that any steel bars, which are not hollow but of rounded-corner triangle in outer shape, may adequately be used, as seen from the cross-sectional performance.

As evidenced above, the triangular pipe 106 is equal in strength to round pipes and round bars, has no possibility of getting damaged on its corner during delivery processes since it is formed in a triangle with rounded corners, is easy to be handled by hand, may be maunfactured as easily as round steel pipes, has no risk to roll down, and, when used as the reinforcing material for concrete- applying frame boards, is easy to be inserted into support pieces arranged with a positional scatter and has the most appropriate form for the twisting operation for rotation; thus, the triangular pipe has such various advantages.

I claim:

1. A device for holding reinforcing materials, adapted to support a supporting structure for molding a fluid type concrete material, comprising:

an arm piece adapted to be attached to the supporting structure, said arm piece extending substantially perpendicularly from the supporting structure and having one end spaced from the supporting structure, at least one bearing section attached to said one end of the arm piece to extend perpendicularly therefrom and having a shaft in said bearing section, at least one support piece pivotally connected to the shaft of the bearing section, said support piece having a support section to receive the reinforcing material therein, said support piece, after the reinforcing material is situated in the support section, being rotated to about the reinforcing material against the supporting structure so that a lower contact point where the reinforcing material contacts the material to be supported is located substantially at the same level as the shaft of the bearing section to immovably hold the reinforcing material against the supporting structure, and a stopper device rotationally connected to the end of the base, said stopper device, while the support piece and additional support piece hold the reinforcing materials, being operated to engage both support piece and additional support piece to hold the same in that position.

2. A device according to claim 1, in which said stopper device includes a projection extending outwardly therefrom, said projection, when pushed by means of the support piece, operating to disengage the stopper device with the additional support piece.

3. A device for holding reinforcing materials, adapted to support a supporting structure for molding a fluid type concrete material, comprising:

an arm piece adapted to be attached to the supporting structure, said arm piece extending substantially perpendicularly from the supporting structure and having one end spaced from the supporting structure, at least one bearing section attached to said one end of the arm piece to extend perpendicularly therefrom and having a shaft in said bearing section, at least one support piece pivotally connected to the shaft of the bearing section, said support piece having a support section to receive the reinforcing material therein, said support piece, after the reinforcing material is situated in the support section, being rotated to abut the reinforcing material against the supporting structure so that a lower contact point where the reinforcing material contacts the material to be supported is located substantially at the same level as the shaft of the bearing section to immovably hold the reinforcing material against the supporting structure, and an additional bearing section attached to said one end of the arm piece to extend downwardly therefrom and having another shaft in said additional bearing section, an additional support piece pivotally connected to said other shaft of the additional bearing section and having another support section to receive the reinforcing material therein, said additional support piece being rotatable so that after the reinforcing material is situated in said additional support section, the additional support piece is rotated to effect secure abutment of the reinforcing material against the supporting structure, and a stopper device rotationally connected to the end of the arm piece, said stopper device, while the support piece and additional support piece hold the reinforcing materials being operated to engage both support piece and additional support piece to hold the same in the position.

4. A device according to claim 1, in which said stopper device includes a projection extending outwardly therefrom, said projection, when pushed by means of the support piece, operating to disengage the stopper device with the additional support piece.

5. A device for holding reinforcing materials adapted to support a supporting structure for molding a fluid type concrete material, comprising:

an arm piece adapted to be attached to the supporting structure, said arm piece having a spacer catching section at an end adjacent to the supporting structure so that the base is supported perpendicular to the supporting structure by means of a spacer passing through the supporting structure and disposed in said speacer catching section, first bearing section attached to an end opposite to the spacer catching section of the arm piece to extend upwardly perpendicularly therefrom and having a first shaft in said bearing section, first support piece pivotally connected to the first shaft of the first bearing section, said first support piece having a first support section to receive the reinforcing material therein, said first support piece, after the reinforcing material is situated in the support section, being rotated to securely abut the reinforcing material against the supporting structure, a second bearing section attached to the end opposite to the spacer catching section to extend downwardly therefrom and having a second shaft in said bearing section, a second support piece pivotally connected to said second shaft of the second bearing section and having second support section to receive the reinforcing material therein, said second support piece being rotatable so that after the reinforcing material is situated in said second support section, the second support piece is rotated to securely about the reinforcing material against the supporting structure; and a stopper device rotationally connected to the end of the arm piece, said stopper device, while the first and second support pieces hold the reinforcing materials, being operated to engage both first and second support pieces to hold the same in that position.

6. A device according to claim 5, in which said stopper device includes a projection extending outwardly therefrom, said projection, when pushed by means of the first support piece, operating to disengage the stopper device with the second support piece.

* * * * *